United States Patent [19]

Barron

[11] Patent Number: 4,742,498

[45] Date of Patent: May 3, 1988

[54] PILOT OPERATED MUD PULSE VALVE AND METHOD OF OPERATING THE SAME

[75] Inventor: C. Dwain Barron, Kingwood, Tex.

[73] Assignee: Eastman Christensen Company, Salt Lake City, Utah

[21] Appl. No.: 916,957

[22] Filed: Oct. 8, 1986

[51] Int. Cl.[4] ..... G01V 1/40

[52] U.S. Cl. ..... 367/85; 367/83

[58] Field of Search ..... 367/83, 85; 175/40, 175/48, 50, 45; 251/282; 33/306, 307

[56] References Cited

U.S. PATENT DOCUMENTS

| | | | |
|---|---|---|---|
| 3,571,936 | 3/1971 | Taylor, Jr. | 33/306 |
| 4,184,545 | 1/1980 | Claycomb | 367/85 |
| 4,351,037 | 9/1982 | Scherbatskoy . | |
| 4,371,958 | 2/1983 | Claycomb | 367/85 |
| 4,386,422 | 5/1983 | Mumby et al. . | |
| 4,520,468 | 5/1985 | Scherbatskoy . | |

*Primary Examiner*—Nelson Moskowitz
*Assistant Examiner*—Ian J. Lobo
*Attorney, Agent, or Firm*—Vaden, Eickenroht, Thompson & Boulware

[57] ABSTRACT

Apparatus for and a method of creating positive pressure pulses in a stream of drilling mud being circulated through a drill string is disclosed. The apparatus includes a restriction in the drill string, a valve member located below the restriction, a cylinder located in the drill string above the restriction, a valve stem connected to the valve member and extending upwardly through the restriction into the cylinder, a piston located in the cylinder and connected to the valve stem, and a restricted passage through the piston through which drilling mud can flow and equalize the pressure across the piston. In operation, opening a pilot valve allows the fluid above the piston to flow through the piston rod to the drill string below the restriction. This creates a pressure differential across the piston that moves it upwardly and causing the valve member to further restrict flow through the valve seat. This creates a pressure pulse. Closing the pilot valve, equalizes the pressure across the piston allowing it and the valve member to move back to their original positions.

12 Claims, 3 Drawing Sheets

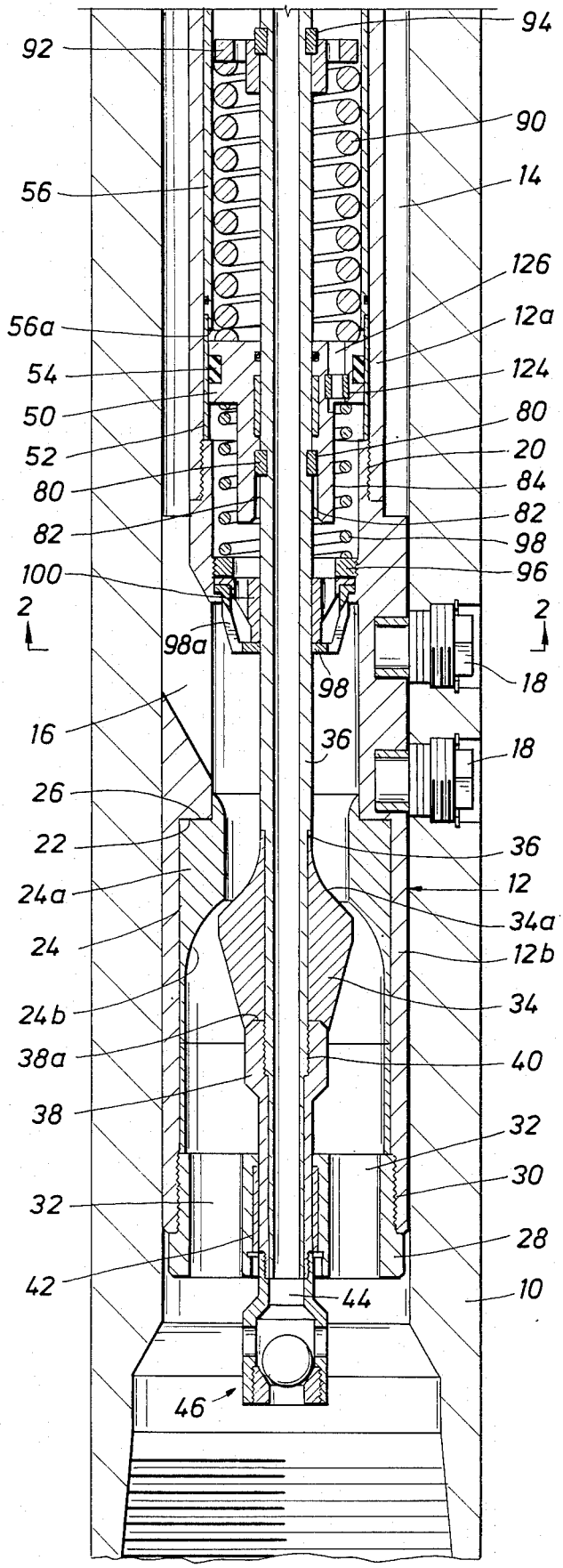
FIG. 1B
FIG. 2
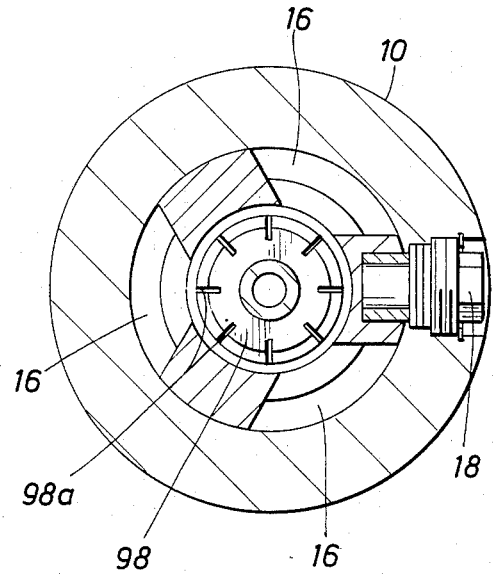

PILOT OPERATED MUD PULSE VALVE AND METHOD OF OPERATING THE SAME

This invention relates to measuring while drilling (MWD) systems generally and in particular to an apparatus for and a method of creating a positive pressure pulse in the flowing drilling mud that can be detected at the surface and by which information can be transmitted to the surface about conditions downhole.

MWD systems have been in use for a number of years to transmit information to the surface, most commonly the inclination and the azimuth of the well bore as it is being drilled, by creating either a positive pressure pulse, i.e., an increase in pressure above the normal circulating pressure or a negative pressure pulse, i.e., a drop in circulating pressure. Positive pressure pulses are created by momentarily restricting the flow of the drilling mud through the drill pipe.

One way of doing this is to place a restriction, such as a valve seat in the drill pipe, to create a pressure drop in the flowing drilling mud even when the valve is open. This difference between the pressure upstream of the valve seat and the pressure downstream of the valve seat is used to cause a piston to move a valve member toward the valve seat to at least partially close the valve and further restrict the flow of the drilling mud momentarily to create a pressure increase in the flowing drilling mud that can be detected at the surface. In all cases, the piston against which upstream pressure acts to move the valve member of the valve toward the valve seat is located downstream of the valve seat and the upstream pressure is supplied to the piston through a conduit or passageway. A pilot valve controls the flow through the passageway and, consequently, the operation of the pulser. Examples of this type of positive pulser are shown in the following U.S. Pat. Nos.:

Jeter; 3,065,416
Spinnler; 3,958,217
Jeter; 4,009,613
LePeuvedic et al; 3,693,428
Dailey; 4,401,134
Roper; 4,519,574
Mumby; 4,550,392

Some use a pump to provide the pressure required to actuate the pulser. Examples of this type are shown in Stone U.S. Pat. No. 4,266,606 and Russell et al U.S. Pat. No. 4,535,429.

The passageway through which fluid at upstream pressure reaches the piston is of necessity relatively small in diameter. This results in some pressure drop occurring in the passageway. The passageway is also subject to being stopped up by solids, particularly when it is drilling mud that flows through the passageway.

It is an object of this invention to provide a mud pulser and a method of operating the pulser in which the operating piston that provides the force to further restrict the flow and create the pulse is located upstream of the valve seat so that upstream pressure acts directly on the piston without having to travel through a passageway.

It is another object of this invention to provide such a pulser wherein the pilot valve is also located upstream of the valve and when open, allows pressure on one side of the piston to drop to downstream pressure thereby creating the differential pressure required to move the piston and, in turn, the valve member of the valve toward the valve seat and when closed, allows the pressure differential across the piston to equalize and the impact of the flowing drilling mud on the valve member to move the valve member downwardly away from the valve seat.

It is a further object and advantage of this invention to provide such a pulser and a method of operating the pulser that will produce pulses having a substantially uniform increase in pressure even though the flow rate of the drilling mud varies.

It is a further object and advantage of this invention to provide a method of creating a pulse that will inherently limit the pressure increase it creates in the flowing drilling mud.

These and other objects, advantages, and features of this invention will be apparent to those skilled in the art from a consideration of this specification, including the appended claims and attached drawings.

In the Drawings:

FIGS. 1A and 1B are vertical sectional views through the preferred embodiment of the pulser of this invention with the pilot valve closed;

FIG. 2 is a sectional view taken along line 2—2 of FIG. 1B; and

Figure 1A:
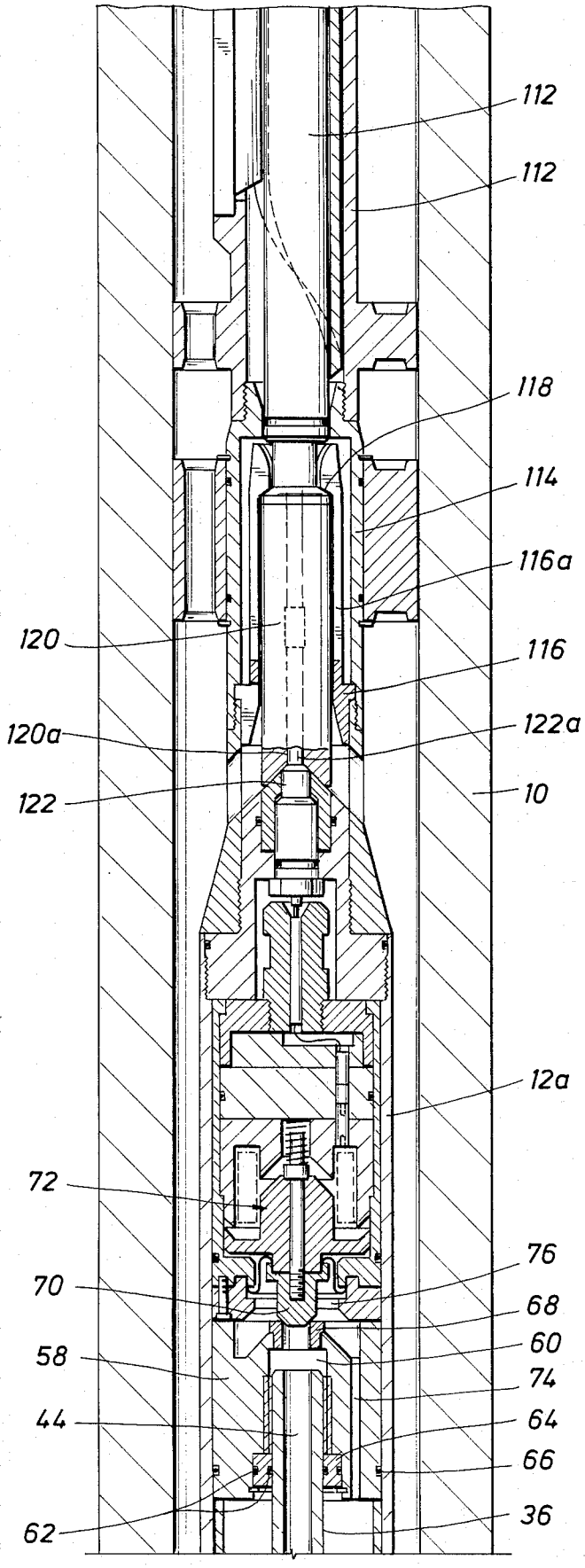

The pulser is usually mounted at the lower end of non-magnetic drill collar, such as collar 10. Pulser housing 12 is made up of two sections, upper housing section **12*a* and lower housing section 12*b*. Upper housing section 12*a* has a diameter less than the inside diameter of collar 10 to provide annulus 14 through which drilling mud can flow downwardly through the collar by the upper housing. Lower housing section 12*b* has a diameter just slightly less than the inside diameter of the collar. Ports 16 are, milled in the upper end of lower housing section 12*b* to allow drilling mud flowing downwardly past upper housing section 12*a* to cross over into the inside bore of lower housing section 12*b*. The pulser is mounted in drill collar 10 by mounting bolts 18 that extend through openings in the wall of the collar and engage blind openings in housing 12. Above openings 16 in the lower housing, the housing reduces its diameter to that of upper housing section 12*a* and the two sections are connected together by threaded connection 20**.

The lower end of the bore through lower housing section **12*b* increases in diameter to provide downwardly facing shoulder 22 that engages upwardly facing shoulder 24 on tubular member 26 and limits the upward movement of sleeve member 24 in the housing. Drilling mud flowing through the housing flows out of the housing through a plurality of ports 32 provided in retainer 28 that hold tubular member 26** in the housing.

Sleeve 24 includes upper thick wall section **24*a* having a downwardly facing arcuate surface 24*b* that serves as a valve seat for the pulser. Positioned below valve seat 24*b* is valve member 34 mounted on piston rod 36. Valve member 34 has a downwardly, outwardly, curving surface 34*a*. It is the movement of surface 34*a* toward and away from valve seat 24*b*** that creates the positive pressure pulses generated by the pulser of this invention.

Valve member 34 is held in place on piston rod 36 by downwardly facing shoulder 36 on the rod above the valve member and upwardly facing shoulder **38*a* on guide member 38 below the valve member. The guide member is connected to the lower end of the piston rod by threads 40. The guide member extends downwardly through bearing sleeve 42 located in a central opening in retainer member 28 that guides the lower end of the rod as it reciprocates along the longitudinal axis of the housing. The piston rod is hollow having a central opening 44 extending throughout its length for purposes that will be described later. Check valve 46 is connected to the lower end of guide sleeve 38 to ensure that drilling mud flows through opening 44** only in a downwardly direction.

Piston rod 36 extends upwardly into section 12*a* of the housing through piston 50 located in the housing. Cylindrical sleeve 52 rests on the upper end of lower housing section 12*b* above threads 20 to provide a smooth cylindrical surface for piston seal ring 54 as the piston reciprocates. Above cylindrical sleeve 52 is spacer sleeve 56 having downwardly facing annular shoulder 56*a* that limits the upward movement of the piston. The upper end of lower housing section 12*b* limits the downward movement of the piston. Spacer sleeve 56 supports cylindrical head 58 that closes off the upper end of the cylindrical portion of the housing in which the piston is located. Piston rod 36 extends into central opening 60 of the cylinder head. The upper end of opening 44 in the piston rod is sealed from the fluid in the cylindrical portion of the housing below the cylinder head by seal rings 62 carried by annular member 64 and by seal ring 66 located between the outer surface of the cylinder head and housing 12*a*.

Valve seat 68 is located in the upper end of opening 60, which is closed when valve element 70 of pilot valve 72 is in engagement with the seat. The cylinder head is also provided with passage 74 that connects the cylindrical section of the housing below to space 76 around the valve element of the pilot valve.

Keys 80 carried by piston rod 36 engage keyways 82 in downwardly extending skirt 84 attached to piston 50. The keys limit the upward relative movement of the piston rod and the piston. As shown in FIG. 1B, the keys are at the upper end of the keyways to transmit any downward movement of the piston to the piston rod. Coil spring 90 is positioned between the upper side of the piston and spring retainer ring 92 that is mounted on the piston rod and held against upward movement relative to the piston rod by snap ring 94. Thus, as the piston moves upwardly in the cylinder, it will move spring 90 and rod 36 upwardly. If, however, the flow of fluid through the drill string is such that the valve member should not close, then the force of the fluid flowing between valve member and the valve seat will compress spring 90 to whatever extent is necessary to keep the pressure drop across the valve from being excessive. This arrangement also causes the pulser to automatically adjust to different flow rates and produce substantially uniform pressure increases regardless of the flow rate.

Positioned below the piston between the piston and threaded stop ring 96 is coil spring 98. This spring allows piston 50 and piston rod 36 to move downwardly under the force of the fluid flowing through the valve below as required to adjust for varying flow rates of drilling fluid, when the pilot valve is closed, while ensuring that a minimum pressure drop is maintained through the valve so that there will be sufficient pressure difference between pressure upstream of the valve and downstream of the valve to operate the pulser in the manner to be described below.

Threaded ring 96 also clamps cup-shaped screw 98 and guide sleeve 100 to the bottom of the housing. The screw has a plurality of vertical slots 98*a* that will screen out the larger solid particles in the mud entering the upper housing. Guide sleeve 100 guides the middle portion of the piston rod for reciprocal movement along the longitudinal axis of the housing.

Located above the pulser in non-magnetic drill collar 10, is probe section 112 that contains the sensors, the electronics, and the source of electrical energy required to operate the system. The probe section is connected to the pulser only by a plug and socket type of electrical connection. This allows the very expensive probe to be removed from the drill pipe should the drill string get stuck in the hole leaving only the pulser of the MWD system at risk.

At the upper end of the pulser is muleshoe 110 that receives and orients probe 112 relative to the pulser. Below the muleshoe is collet 114, which has a plurality of arms 116*a* that will engage upwardly facing tapered shoulder 118 on electrical connector housing 120. This section rests upon the housing. The pulser's electrical probe connection 122 has plug 122*a* that extends into socket 120*a* to connect pilot valve 72 to the electrical circuits of the probe. Power can now be supplied to the pulser to produce pressure pulses in a desired sequence to send information to the surface. Collet 114 will hold probe connector 120 in engagement with the plug connector of the pulser during normal drilling operations. An upward pull by a wireline, however, will cause tapered shoulder 118 to force arms 116*a* outwardly releasing the probe for removal from the drill pipe.

Figure 3:
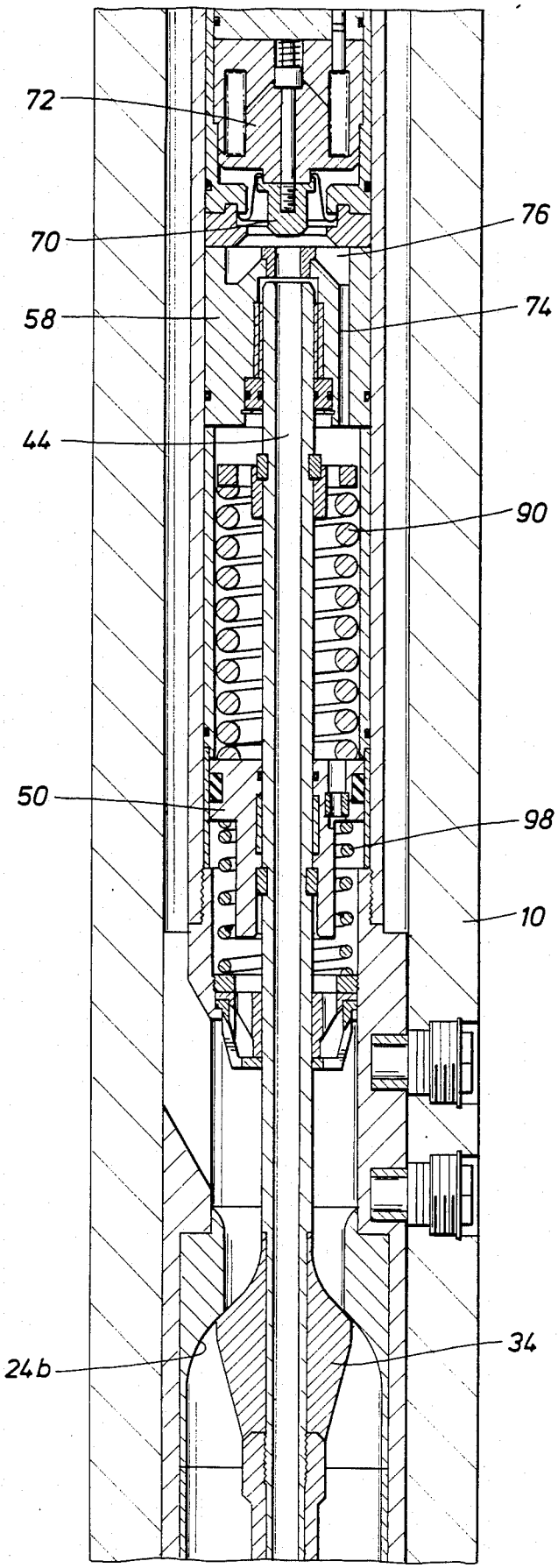
FIG. 3 is a vertical sectional view of the apparatus shown in FIG. 1B with the pilot valve open and the valve member moved upwardly to create a pressure pulse in the flowing drilling mud.

In operation, power is supplied to pilot valve 72 moving valve element 70 out of engagement with valve seat 68. At this time, the pressure on both sides of piston 50 has equalized through flow restriction 124 and passage 126. So when the pilot valve is closed as shown in FIGS. 1A and 1B, the pressure across the piston is equal and the only movement that would occur would be caused by the fluid flowing through the valve exerting a force on the valve element causing it to outwardly compressing as allowed by spring 98 positioned below the spring. Opening the pilot valve immediately allows fluid to flow from above the piston through passage 74 in the cylinder head and through the open pilot valve into central passage 44 of the piston rod to the downstream side of the valve seat. This reduces the pressure above the piston faster than it can be rebuilt by the fluid flowing through choke or flow restriction 124 creating a pressure differential across the piston that will move the piston upwardly to the extent allowed by shoulder 56*a*. This will move valve element 34 upwardly toward valve seat 24*b* creating a sharp rise in pressure in the drilling fluid in the drill string above the valve seat that can be sensed at the surface. In FIG. 3, the valve is shown closed. It is likely that this will probably not occur in practice, since the flow of fluid through the valve will be such that it will compress spring 90 as required to limit the pressure increase.

After the pulse is created, pilot valve 72 closes, the pressure across the piston begins to equalize, and the piston and valve member move down to the position shown in FIG. 1B.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for creating positive pressure pulses in a stream of drilling mud being circulated through a drill string comprising a restriction in the drill string, a valve member located below the restriction, a cylinder located in the drill string above the restriction, a valve stem connected to the valve member and extending upwardly through the restriction into the cylinder, a piston located in the cylinder and connected to the valve stem, first passage means in the cylinder through which drilling mud upstream of the restriction can enter the cylinder and act against the piston urging it upwardly to move the valve member upwardly toward the restriction to restrict the flow of drilling mud through the seat and create a pressure pulse, second restricted passage means through which drilling mud upstream of the restriction can reach the cylinder above the piston and equalize the pressure across the piston, third passage means through which drilling mud can flow from the cylinder above the piston to the drill string below the restriction, and pilot valve means for opening the third passage means to cause the pressure in the cylinder above the piston to drop below upstream pressure to produce a pressure differential across the piston acting to move the piston upwardly away from the restriction and the valve member upwardly toward the restriction to create a pressure pulse in the drilling mud and to close the third passage means to cause the pressure across the piston to equalize allowing the force of the flowing drilling mud on the valve member to move the valve member downwardly away from the restriction.

2. The apparatus of claim 1 further provided with resilient means urging the valve member upwardly toward the restriction to maintain a pressure drop across the restriction sufficient to move the piston and create a pulse in the drilling mud.

3. The apparatus of claim 2 in which the resilient means located below the piston to urge the piston upwardly away from the restriction and the valve member upwardly toward the restriction.

4. The apparatus of claim 1 further provided with resilient means urging the valve element toward the restriction to maintain a sufficient pressure drop across the restriction when the pilot valve is closed to ensure a sufficient pressure differential across the piston when the pilot valve opens to move the piston initially against the force imposed on the valve member by the flowing drilling mud.

5. The apparatus of claim 1 further provided with means to limit the pressure differential across the restriction when the pilot valve is open to limit the pressure increase created in the drilling mud by the apparatus.

6. The apparatus of claim 5 in which the means to limit the pressure differential across the piston include mounting the valve element on the valve rod for sliding movement along the rod and resilient means carried by the rod below the valve member urging the valve member toward the restriction and to allow the space between the valve member and the restriction to vary as required to produce a substantially uniform increase in pressure for each pulse.

7. Apparatus for creating positive pressure pulses in drilling mud being pumped through a pipe string for sending information to the surface comprising a housing forming a part of the drill string through which which the drilling mud passes, a valve seat in the housing, a cylinder mounted in the housing above the valve seat with its longitudinal axis extending along the longitudinal axis of the housing, said cylinder having an opening in its lower end through which drilling mud can enter the cylinder at all times and an end wall closing the upper end of the cylinder, a piston located in the cylinder for the pressure of the drilling mud entering the lower end of the cylinder to act against the lower side of the piston and urge the piston upwardly in the cylinder, a piston rod located in the cylinder and extending downwardly through the cylinder through the piston and through the valve seat, said piston rod having a passage through which drilling mud can flow from above the piston through the rod to the housing below the valve seat, means for urging the piston rod to move with the piston, a valve element mounted on the piston rod below the valve seat for movement toward and away from the valve seat to create pressure pulses in the flowing drilling mud as the piston rod reciprocates in the cylinder, a passage connecting the cylinder above the piston to the passage in the piston rod to allow the pressure of the drilling mud above the piston to drop below the pressure of the mud below the piston to cause the pressure below to move the piston upwardly and cause the valve element to restrict the flow of mud through the valve seat and create a pulse in the drilling mud that is detectable at the surface, pilot valve means for allowing such flow when open and to prevent it when closed, and passage means connecting the cylinder below the piston to the cylinder above the piston, said flow through the passage being restricted so drilling mud can flow across the piston when the pilot valve is open at a rate below the rate of flow through the piston rod but at a rate that will cause the pressure across the piston to equalize rapidly when the pilot valve is closed.

8. The apparatus of claim 7 further provided with resilient means urging the valve element toward the valve seat when the pilot valve means is closed to maintain a sufficient pressure drop across the valve seat when the pilot valve is closed to ensure a sufficient pressure differential across the piston when the pilot valve opens to move the piston initially against the force imposed on the valve member by the flowing drilling mud.

9. The apparatus of claim 7 in which the means for urging the piston rod to move with the piston comprises a resilient member in the cylinder above the piston and connected at its upper end to the piston rod to urge the piston rod to move upwardly with the piston when the pilot valve opens while allowing the distance moved by the rod and the valve element to adjust as required by the volume of drilling mud flowing through the valve seat by compressing the resilient member.

10. Apparatus for creating positive pressure pulses in a stream of drilling mud being circulated through a drill string comprising a valve seat in the drill string, a valve member located below the valve seat, resilient means urging the valve member towards the valve seat to restrict the flow of drilling mud through the valve seat to maintain a minimum pressure drop across the valve seat, a cylinder located in the drill string above the valve seat, a piston located in the cylinder, a piston rod connected to the valve member and extending upwardly through the valve seat into the cylinder and through the piston, means urging the piston rod to move upwardly with the piston, first passage means in the cylinder through which drilling mud upstream of the valve seat can enter the cylinder and act against the piston urging it upwardly to move the valve member upwardly toward the valve seat to restrict the flow of drilling mud through the seat and create a pressure pulse, second restricted passage means through which drilling mud upstream of the valve seat can reach the cylinder above the piston and equalize the pressure across the piston, third passage means through which drilling mud can flow from the cylinder above the piston to the drill string below the valve seat, and pilot valve means for opening the third passage means to cause the pressure in the cylinder above the piston to drop below upstream pressure to produce a pressure differential across the piston acting to move the piston and the valve member upwardly toward the valve seat and create a pressure pulse in the drilling mud and to close the third passage means to cause the pressure across the piston to equalize allowing the force of the flowing drilling mud on the valve member to move the valve member and the piston downwardly to the extent allowed by the resilient means.

11. The apparatus of claim 10 in which the means for urging the piston rod to move with the piston comprises a resilient member in the cylinder above the piston and connected at its upper end to the piston rod to urge the piston rod to move upwardly with the piston when the pilot valve opens while allowing the distance moved by the rod and the valve element to adjust as required by the volume of drilling mud flowing through the valve seat by compressing the resilient member.

12. A method of creating positive pressure pulses in drilling mud being circulated downwardly through a drill string to transmit information to the surface by moving a valve member toward and away from a valve seat through which the drilling mud flows by varying the pressure differential across a piston located in a cylinder above the valve seat and connected to the valve member through a resilient member that allows the distance the valve member moves toward the valve seat to automatically adjust to different rates of flow to produce pulses having a generally uniform increase in pressure above the circulating pressure comprising the steps of exposing the lower side of the piston to the pressure of the drilling fluid above the valve seat, connecting the cylinder above the piston to the pressure of the drilling fluid above the valve seat through a restricted passage, connecting the cylinder above the piston to downstream pressure through a passage larger than the restricted passage to cause a pressure differential across the piston that will move the piston and the valve element through the resilient means upwardly toward the valve seat and create a pressure pulse, and stopping the flow through the larger passage to allow the pressure to equalize across the piston through the restricted passage.

* * * * *